US009337595B1

(12) United States Patent
Herring et al.

(10) Patent No.: US 9,337,595 B1
(45) Date of Patent: May 10, 2016

(54) BUSBAR CONNECTION SYSTEM

(71) Applicant: Tyco Electronics Corporation, Berwyn, PA (US)

(72) Inventors: Michael David Herring, Apex, NC (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 36 days.

(21) Appl. No.: 14/514,456

(22) Filed: Oct. 15, 2014

(51) Int. Cl.
*H01R 11/09* (2006.01)
*H01R 25/16* (2006.01)

(52) U.S. Cl.
CPC ..... *H01R 25/16* (2013.01)

(58) Field of Classification Search
CPC ..... H01R 31/02; H01R 4/2433
USPC ..... 439/724, 417, 723, 397, 404
See application file for complete search history.

(56) References Cited

U.S. PATENT DOCUMENTS

| | | | | |
|---|---|---|---|---|
| 6,840,820 | B2 * | 1/2005 | Oda | H01R 13/518 439/721 |
| 6,969,285 | B2 * | 11/2005 | Kobayashi | H01R 9/223 439/723 |
| 7,419,377 | B1 * | 9/2008 | Briere | H01L 31/0508 439/32 |
| 7,499,262 | B1 * | 3/2009 | Darr | H01R 9/226 361/626 |
| 7,649,731 | B2 * | 1/2010 | Parrish | B60R 16/0238 174/254 |
| 2001/0009825 | A1 * | 7/2001 | Kasai | H01R 9/2458 439/724 |
| 2009/0111294 | A1 | 4/2009 | Barry et al. | |

* cited by examiner

*Primary Examiner* — Phuongchi T Nguyen

(57) ABSTRACT

A busbar connection system includes a busbar and a busbar connector having a base and first and second flexible mounting arms extending from the base. The base is secured to the busbar. The first and second flexible mounting arms each have termination portions extending therefrom. The termination portions are configured for mechanical and electrical termination to an electrical component. The flexible mounting arms allow relative movement between the busbar and the electrical component.

20 Claims, 3 Drawing Sheets

BUSBAR CONNECTION SYSTEM

BACKGROUND OF THE INVENTION

The subject matter herein relates generally to busbar connector systems.

In various electrical systems, power may be delivered to or from electrical components, such as a printed circuit board (PCB), through a busbar. A typical busbar includes a planar strip of conductive material, such as copper or a copper alloy, having opposite sides that are engaged by terminals.

Busbars are typically secured to the PCB using a busbar connector having a threaded fastener (for example, a screw) that requires one or more large holes in the PCB to pass the threaded fastener therethrough. Attaching the fasteners to the PCB can be difficult, requiring a certain torque for proper application, and may cause damage to the PCB. The large holes can also cause challenges for signal routing in the PCB. Additionally, the busbar may be required to be positioned flat against the PCB to align the threaded fastener with the PCB. As such, the busbar may take up valuable space on the PCB as opposed to standing the busbar vertically. However, in order to stand the busbar vertically, folds may be introduced into the busbar creating waste and unused material when the busbar is stamped and formed. Additionally, the busbar may be soldered onto solder pads on the PCB. However, because the busbar is typically designed to dissipate heat, soldering may be cumbersome and may require specialized tooling.

Further, in use, the busbar may transmit high current or voltage, which may cause the busbar to generate heat. As the temperature of the busbar increases, the busbar may expand and thus move. The movement of the busbar causes the busbar connector to induce strain on the PCB, which may damage the PCB.

A need remains for a busbar connector that is easier to manage during manufacture and can accommodate movement of the busbar.

BRIEF DESCRIPTION OF THE INVENTION

In one embodiment, a busbar connection system is provided that includes a busbar and a busbar connector having a base and first and second flexible mounting arms extending from the base. The base is secured to the busbar. The first and second flexible mounting arms each have termination portions extending therefrom. The termination portions are configured for mechanical and electrical termination to an electrical component. The flexible mounting arms allow relative movement between the busbar and the electrical component.

In another embodiment, a busbar connector is provided that includes a base configured to be mechanically and electrically connected to a busbar. The busbar connector also has first and second flexible mounting arms extending from the base. The first and second flexible mounting arms are each generally U-shaped having inner and outer legs with a folded-over section therebetween. Each of the first and second flexible mounting arms include one of the inner leg or the outer leg extending from the base and the other of the inner leg or the outer leg having a termination portion configured for mechanical and electrical termination to an electrical component. The first and second flexible mounting arms are flexible to allow relative movement between the busbar and the electrical component.

DETAILED DESCRIPTION OF THE INVENTION

Figure 1:
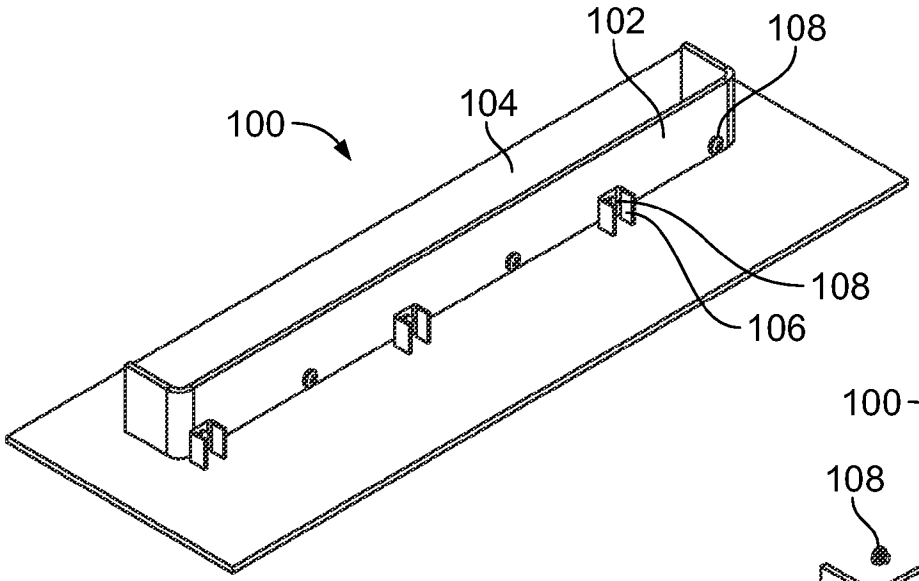
FIG. 1 is a perspective view of a busbar connection system formed in accordance with an exemplary embodiment.
Figure 2:
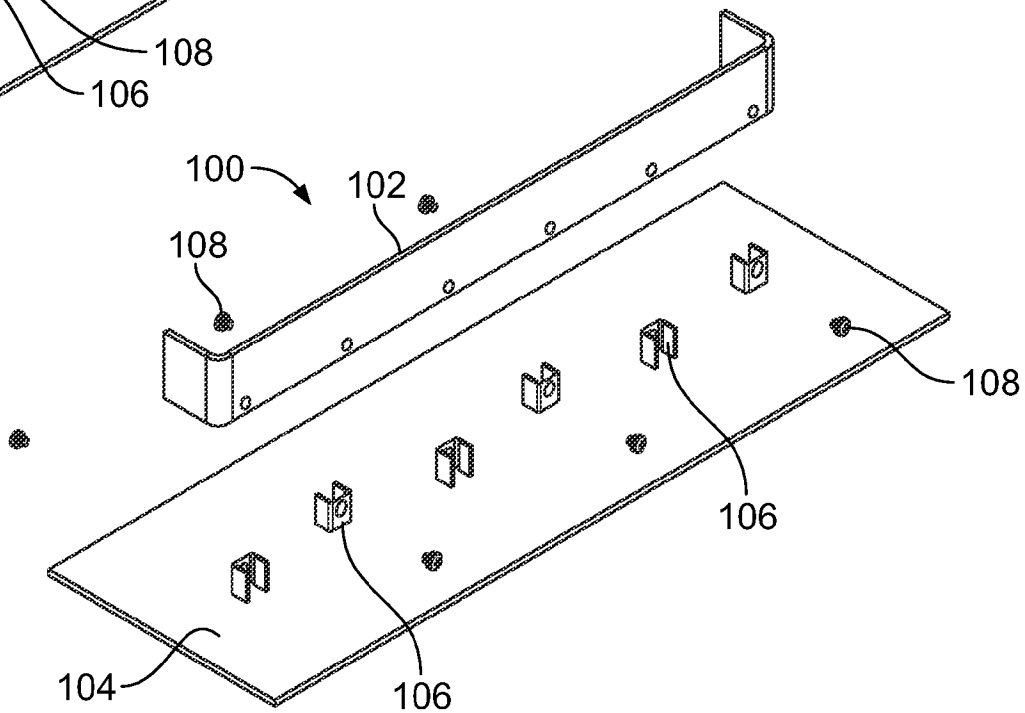
FIG. 2 is an exploded perspective view of the busbar connection system.

FIG. 1 is a perspective view of a busbar connection system 100 formed in accordance with an exemplary embodiment. FIG. 2 is an exploded perspective view of the busbar connection system 100. The busbar connection system 100 includes a busbar 102 electrically and mechanically coupled to an electrical component 104 using one or more busbar connectors 106. In an exemplary embodiment, the electrical component 104 is a printed circuit board; however, the busbar 102 may be coupled to any type of electrical component in alternative embodiments.

The busbar connection system 100 may be used in any application in which high voltage and/or current is conveyed. For example, the busbar 102 may be configured to conduct large electrical currents. For example, the busbar 102 may be used in a power controller in a hybrid vehicle. Optionally, the busbar 102 may be configured as a heatsink to draw heat away from the electrical component 104. The busbar 102 may be made of any electrically or thermally conductive material. For example, the busbar 102 may be made of copper or a copper alloy.

The busbar connectors 106 are mounted to the electrical component 104 and the busbar 102 is attached to the busbar connectors 106 using fasteners 108. The fasteners 108 may be threaded fasteners, such as nuts and bolts, however other types of fasteners may be used in alternative embodiments to secure the busbar 102 to the busbar connectors 106. The busbar connectors 106 allow the busbar 102 to be attached in an upright (e.g., vertical) orientation relative to the electrical component 104. For example, the busbar may be oriented generally perpendicular to a mounting surface of the electrical component 104.

The busbar connectors 106 are manufactured from conductive material, such as copper or a copper alloy. The busbar connectors 106 transmit high current or voltage between the electrical component 104 and the busbar 102. Optionally, each busbar connector 106 is a one piece stamped and formed body that is mounted to the electrical component 104 and the busbar 102 to create an electrical path therebetween. In an exemplary embodiment, the busbar connectors 106 are flexible and allow relative movement between the busbar 102 and the electrical component 104. As such, when the temperature of the busbar 102 increases and the busbar 102 expands or changes shape, the busbar connectors 106 may accommodate the relative movement of the busbar 102 and the electrical component 104, which may avoid damage to the electrical component 104.

Figure 3:
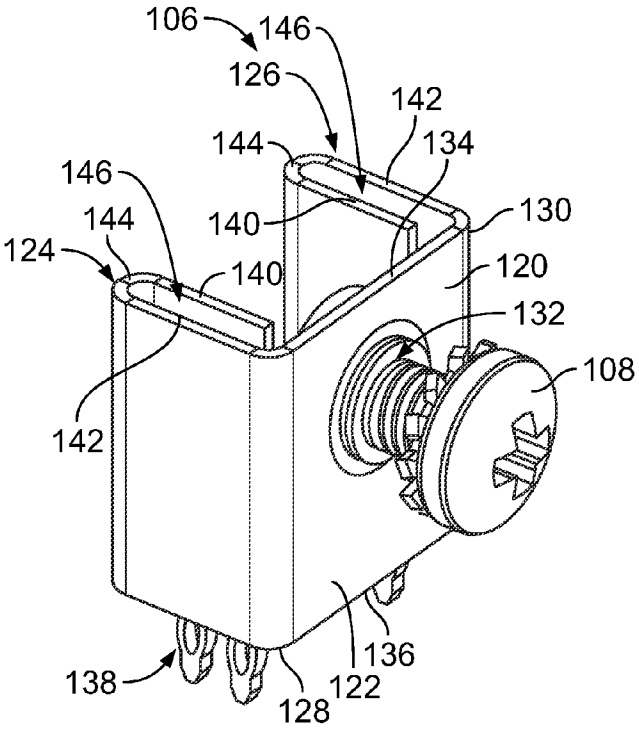
FIG. 3 is a front perspective view of a busbar connector of the busbar connection system shown in FIG. 1 and formed in accordance with an exemplary embodiment.

FIG. 3 is a front perspective view of the busbar connector 106 formed in accordance with an exemplary embodiment. The busbar connector 106 includes a conductive body 120. Optionally, the body 120 may be a one-piece stamped and formed body. The busbar connector 106 includes a base 122 that is configured to be mounted to the busbar 102 (shown in FIG. 1).

The busbar connector 106 includes first and second flexible mounting arms 124, 126 extending from opposite ends 128, 130, respectively, of the base 122. The flexible mounting arms 124, 126 are configured to be mounted to the electrical component 104 (shown in FIG. 1). The flexible mounting arms 124, 126 are flexible and allow movement relative to each other and/or relative to the base 122. As such, the bus bar 102 is able to move relative to the electrical component 104.

In an exemplary embodiment, the base 122 includes an opening 132 therethrough. The opening 132 is configured to receive the fastener 108 to secure the busbar 102 to the busbar connector 106. In an exemplary embodiment, the base 122 is planar and extends between the ends 128, 130, a top 134 and a bottom 136. Optionally, the base 122 may be rectangular in shapes; however the base 122 may have other shape in alternative embodiments.

The flexible mounting arms 124, 126 have termination portions 138 extending therefrom that are configured to be mechanically and electrically terminated to the electrical component 104. In the illustrated embodiment, the termination portions 138 are compliant pins, such as eye-of-the-needle pins, which may be press-fit into corresponding vias of the electrical component 104. Other types of termination portions may be used in alternative embodiments, such as solder tabs, solder tails, fasteners, and the like.

In an exemplary embodiment, the flexible mounting arms 124, 126 are U-shaped. The flexible mounting arms 124 each include an inner leg 140 and an outer leg 142 with a folded-over section 144 therebetween. In the illustrated embodiment, the flexible mounting arms 124, 126 are folded inward such that the outer legs 142 extend or transition from the ends 128, 130 of the base 122. The folded-over section 144 is distal from the base 122 and the inner leg 140 is bent inward and extends toward the base 122 from the folded-over section 144. The termination portions 138 extend from the inner legs 140, such as from the bottoms of the inner legs 140. However, in alternative embodiments, the flexible mounting arms 124 may be folded outward with the inner legs 140 transitioning from the base 122 and with the termination portions 138 extending from the outer legs 142. The inner leg 140 and/or the outer leg 142 may be flexible and resiliently deformable to change the shape of the corresponding flexible mounting arm 124, 126 to allow relative movement between the busbar 102 and the electrical component 104.

In an exemplary embodiment, the inner and outer legs 140, 142 are generally parallel to each other and are separated by a gap 146. Optionally, the inner and outer legs 140, 142 may be generally perpendicular to the base 122. Alternatively, the inner and outer legs 140, 142 may extend at any angle relative to the base 122. The inner and outer legs 140, 142 may be angled non-parallel to each other.

Figure 4:
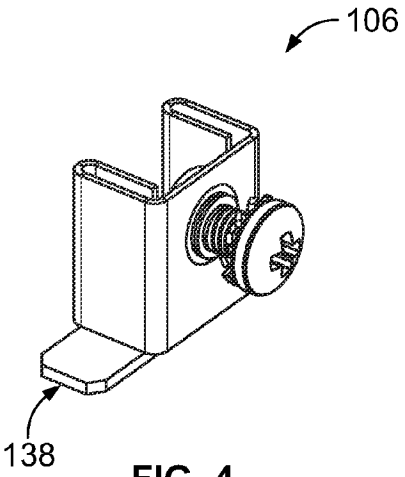
FIG. 4 is a front perspective view of the busbar connector formed in accordance with an exemplary embodiment.

FIG. 4 is a front perspective view of the busbar connector 106 formed in accordance with an exemplary embodiment. The busbar connector 106 shown in FIG. 4 includes termination portions 138 in the form of solder tabs.

Figure 5:
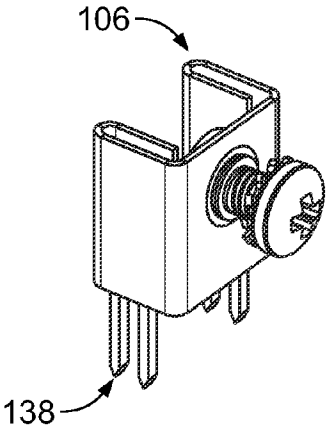
FIG. 5 is a front perspective view of the busbar connector formed in accordance with an exemplary embodiment.

FIG. 5 is a front perspective view of the busbar connector 106 formed in accordance with an exemplary embodiment. The busbar connector 106 shown in FIG. 5 includes termination portions 138 in the form of solder tails.

Figure 6:
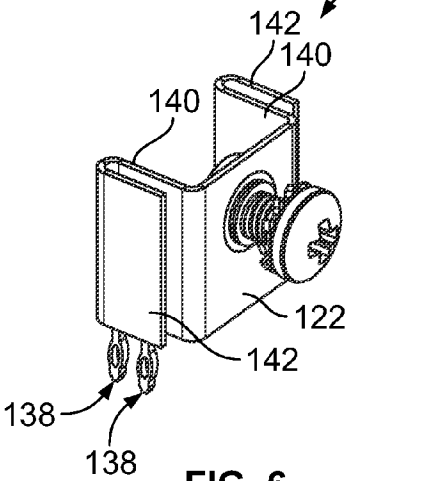
FIG. 6 is a front perspective view of the busbar connector formed in accordance with an exemplary embodiment.

FIG. 6 is a front perspective view of the busbar connector 106 formed in accordance with an exemplary embodiment. In the illustrated embodiment, the termination portions 138 extend from the outer legs 142, while the inner legs 140 extend from the base 122.

Figure 7:
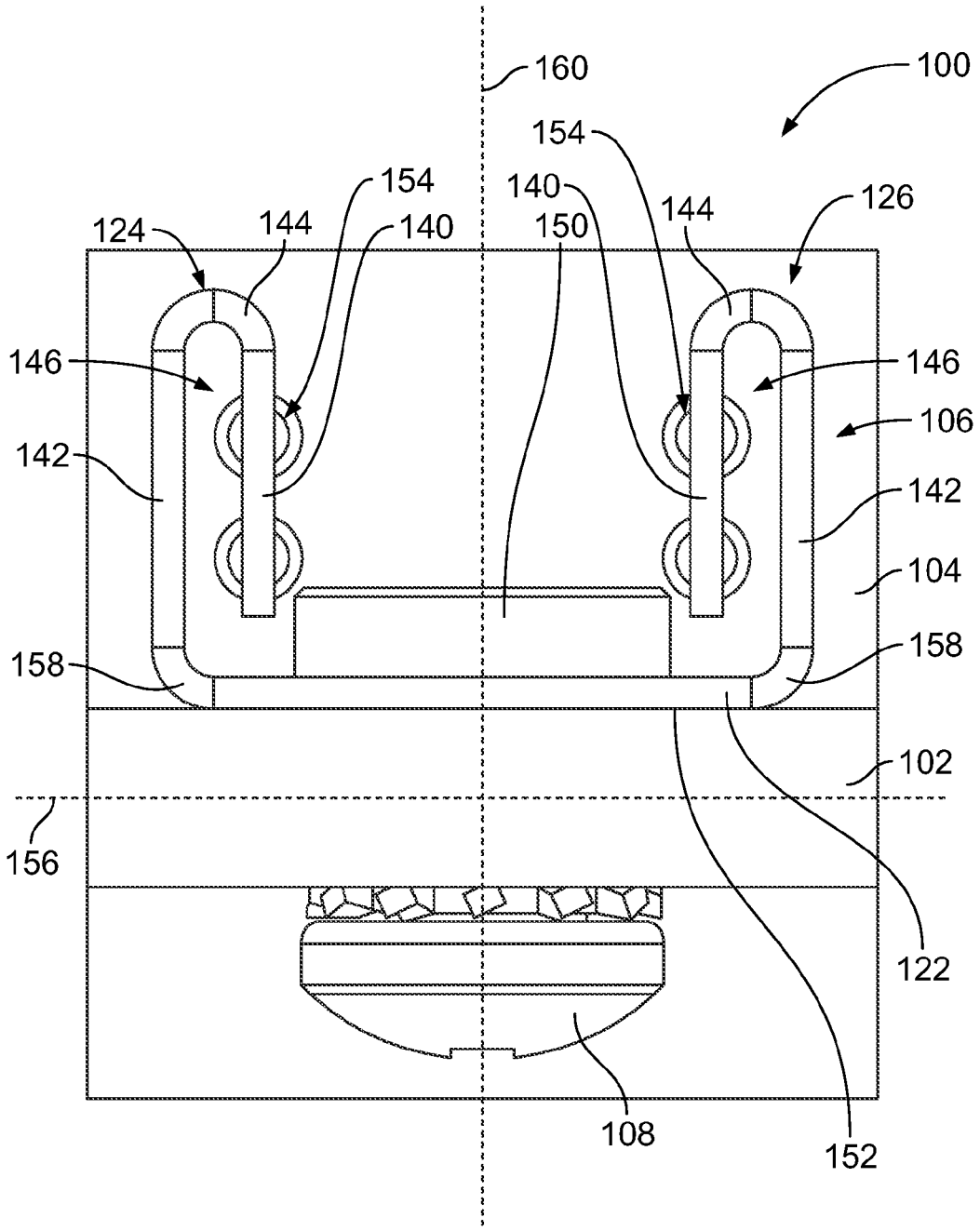
FIG. 7 is a top view of a portion of the busbar connection system showing the busbar connector mounted to an electrical component and a busbar.

FIG. 7 is a top view of a portion of the busbar connection system 100 showing the busbar connector 106 mounted to the electrical component 104 and the busbar 102. The fastener 108 is used to secure the busbar 102 to the busbar connector 106. Optionally, the fastener 108 may be a threaded bolt and a nut 150 is used to secure the threaded bolt in position. The fastener 108 presses the busbar 102 against a front 152 of the base 122. The base 122 is in direct electrical contact with the busbar 102. The busbar 102 is captured between the head of the fastener 108 and the front 152 of the base 122. A lock washer may be used to lock rotation of the fastener 108 and prevent loosening of the fastener 108.

The busbar connector 106 is mounted to the electrical component 104 by loading the compliant pins of the termination portions 138 (FIG. 3) into conductive vias 154 of the electrical component 104. Other termination processes may be used in alternative embodiments such as soldering. When the termination portions 138 are terminated to the vias 154 the termination portions 138 are fixed relative to the electrical component 104. As such, in the illustrated embodiment, the inner legs 140 define fixed legs of the flexible mounting arms 124, 126, and may be referred to hereinafter as fixed legs 140. In alternative embodiments the outer legs 142 may define the fixed legs. The fixed legs 140 are fixed to the electrical component 104 and do not move relative to each other or relative to the electrical component 104.

The folded-over sections 144 transition to the outer legs 142, which define intermediate legs that are positioned between the fixed legs 140 and the base 122. As such, the outer legs 142 may be referred to hereinafter as intermediate legs 142. In an exemplary embodiment, the intermediate legs 142 are flexible and resiliently deformable to change the shape of the flexible mounting arms 124, 126 and to change the shape of the gap 146.

In use, the flexible mounting arms 124, 126 allow relative movement between the busbar 102 and the electrical component 104. For example, the busbar 102 may be shifted longitudinally along a longitudinal axis 156, such as to the right or to the left relative to the fixed legs 140. As the busbar 102 is shifted longitudinally, the base 122 moves with the busbar 102. The folded-over sections 144 may be flexed, such as by expanding or contracting and changing the relative angles between the intermediate legs 142 and the fixed legs 140. For example, one of the intermediate legs 142 may be spread apart from the corresponding fixed leg 140 while the other intermediate leg 142 is brought closer to the corresponding fixed leg 140. In an exemplary embodiment, the corners 158 where the intermediate legs 142 transition into the base 122 are flexible to allow the relative angles between the intermediate legs 142 and the base 122 to change as the busbar 102 is shifted to the right or to the left.

Optionally, the busbar 102 may shift laterally along a lateral axis 160 that is generally perpendicular to the base 122. For example, the folded-over sections 144 may be flexible to allow the busbar 102 to shift laterally.

The U-shaped spring design of the flexible mounting arms 124, 126 provides compliance to minimize or counteract potential stresses in the electrical component 104 and/or the busbar 102. For example, stress is generated from the materials of the electrical component 104 and the busbar 102 expanding at different rates due to thermal expansion. For example, because of material mismatch between the electrical component 104 and the busbar 102, the bus bar 102 may tend to move relative to the electrical component 104. Such movement, and stress caused by such movement, may be counteracted by allowing the busbar 102 to float relative to the electrical component 104 in one or more directions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A busbar connection system comprising:

a busbar, a busbar connector having a base and first and second flexible mounting arms extending from the base, the base being secured to the busbar, the first and second flexible mounting arms each having a respective termination portion extending therefrom, the termination portions being configured for mechanical and electrical termination to an electrical component;

wherein the flexible mounting arms allow relative movement between the busbar and the electrical component when the busbar connector is secured to the electrical component.

2. The busbar connection system of claim 1, wherein the first and second flexible mounting arms are U-shaped.

3. The busbar connection system of claim 1, wherein the first and second flexible mounting arms each have an inner leg and an outer leg, wherein the base extends from the outer legs, and the termination portions extend from the inner legs.

4. The busbar connection system of claim 1, wherein the first and second flexible mounting arms each have a fixed leg with the termination portions extending from the fixed legs such that the fixed legs are fixed to the electrical component, and wherein the first and second flexible mounting arms each have an intermediate leg transitioning between the fixed leg and the base, wherein a gap is formed between the fixed leg and the intermediate leg, at least one of the fixed leg and the intermediate leg being flexible and resiliently deformable to change the shape of the gap and allow relative movement between the busbar and the electrical component.

5. The busbar connection system of claim 1, wherein the base is planar, the base being mounted to the busbar such that the base is in direct electrical contact with the busbar.

6. The busbar connection system of claim 1, wherein the first and second flexible mounting arms extend from opposite ends of the base.

7. The busbar connection system of claim 1, wherein the termination portions further comprise solder tabs.

8. The busbar connection system 1, wherein the termination portions further comprise press-fit tails.

9. The busbar connection system of claim 1, wherein the termination portions further comprise through-hole solder tails.

10. The busbar connection system of claim 1, wherein the first and second flexible mounting arms are compliant to flex along a longitudinal axis that is generally parallel to the base.

11. The busbar connection system of claim 1, wherein the first and second flexible mounting arms are complaint to flex along a lateral axis that is generally perpendicular to the base.

12. The busbar connection system of claim 1, wherein the busbar connector comprises a one piece stamped and formed body.

13. The busbar connection system of claim 1, wherein the first and second flexible mounting arms each have an inner leg and an outer leg with a folded-over section therebetween, the inner and outer legs being parallel to each other.

14. The busbar connection system of claim 13, wherein the inner and outer legs are generally perpendicular to the base.

15. A busbar connector comprising:

a base configured to be mechanically and electrically connected to a busbar;

first and second flexible mounting arms extending from the base, the first and second flexible mounting arms each being generally U-shaped and having an inner leg and an outer leg with a folded-over section therebetween, each of the first and second flexible mounting arms having one of the inner leg and the outer leg extending from the base and the other of the inner leg and the outer leg having a termination portion configured for mechanical and electrical termination to an electrical component, the first and second flexible mounting arms being flexible to allow relative movement between the busbar and the electrical component.

16. The busbar connector of claim 15, wherein the base is planar and includes an opening therethrough configured to receive a fastener to connect the base to the busbar such that the base is in direct electrical contact with the busbar.

17. The busbar connector of claim 15, wherein the first and second flexible mounting arms are compliant to flex along a longitudinal axis that is generally parallel to the base.

18. The busbar connector of claim 15, wherein the first and second flexible mounting arms are complaint to flex along a lateral axis that is generally perpendicular to the base.

19. The busbar connector of claim 15, wherein the inner and outer legs are generally parallel to each other.

20. The busbar connector of claim 19, wherein the inner and outer legs are generally perpendicular to the base.

* * * * *